US006262660B1

(12) United States Patent
Segale et al.

(10) Patent No.: US 6,262,660 B1
(45) Date of Patent: Jul. 17, 2001

(54) CHILD PROXIMITY TRANSMITTER

(76) Inventors: Erica Marmon Segale; Christopher Segale, both of 283 Linden St., Massapequa Park, NY (US) 11762

( * ) Notice: Subject to any disclaimer, the term of this patent is extended or adjusted under 35 U.S.C. 154(b) by 0 days.

(21) Appl. No.: 09/303,236

(22) Filed: Apr. 30, 1999

(51) Int. Cl.[7] ..... G08B 1/08; G08G 1/123

(52) U.S. Cl. ..... 340/539; 340/994; 340/573.1

(58) Field of Search ..... 340/539, 572.1, 340/573.1, 573.3, 573.4, 825.49, 825.36, 10.1, 994

(56) References Cited

U.S. PATENT DOCUMENTS

| | | | | |
|---|---|---|---|---|
| 4,325,057 | * | 4/1982 | Bishop | 340/539 |
| 4,750,197 | * | 6/1988 | Denekamp et al. | 235/385 |
| 4,797,948 | * | 1/1989 | Milliorn et al. | 340/991 |
| 5,144,301 | * | 9/1992 | Jackson et al. | 340/994 |
| 5,218,344 | * | 6/1993 | Ricketts | 340/573 |
| 5,298,883 | * | 3/1994 | Pilney et al. | 340/573 |
| 5,519,381 | * | 5/1996 | Marsh et al. | 340/572 |
| 5,557,259 | * | 9/1996 | Musa | 340/573.4 |
| 5,640,147 | * | 6/1997 | Chek et al. | 340/573.1 |
| 5,646,593 | * | 7/1997 | Hughes et al. | 340/573.4 |
| 5,689,240 | * | 11/1997 | Traxler | 340/573.4 |
| 5,745,037 | * | 4/1998 | Guthrie et al. | 340/539 |
| 5,870,029 | * | 2/1999 | Otto et al. | 340/825.36 |
| 5,995,019 | * | 11/1999 | Chieu et al. | 340/825.54 |

* cited by examiner

*Primary Examiner*—Donnie L. Crosland
(74) *Attorney, Agent, or Firm*—Michael I Kroll

(57) ABSTRACT

A locator system for determining when an object has entered a predetermined monitoring area. The locator system includes a central base unit and at least one remote unit. The central base unit includes a transmitter for transmitting a monitoring signal within the predetermined area, an alarm signal generator and a receiver. Each of the at least one remote units includes a receiver for receiving the monitoring signal when positioned within the monitoring area and a device for generating and transmitting a response signal for receipt by the receiver in the central base unit. The central base unit is caused to generate an alarm signal upon receipt of the response signal thereby alerting a person monitoring the central base unit that the at least one remote unit has entered the monitoring area. The central base unit may include a device for adjusting a strength of the monitoring signal and thereby adjust the size of the monitoring area. Alternatively, the remote unit may include a device for adjusting a strength of the response signal and thereby adjust the size of the monitoring area. When more than one remote unit is being monitored by the central base unit each of the remote units is identified by a respective identification code, the identification codes being stored within a processor of the central base unit, the identification code being transmitted by respective remote units with the response signal.

1 Claim, 7 Drawing Sheets

CHILD PROXIMITY TRANSMITTER

BACKGROUND OF THE INVENTION

1. Field of the Invention

The present invention relates generally to locator/proximity devices and, more specifically, to a device able to alert a person located at a central station when a remote device moves within a predetermined distance from the central station, the remote device being secured to a person or object being monitored.

2. Description of the Prior Art

Numerous locator/proximity devices designed to locate and monitor the location of a remote signaling device are illustrated in the prior art. For example, U.S. Pat. Nos. 5,640,147; 5,557,259; 5,646,593 and 5,689,240 are illustrative of such devices. While these locator/proximity devices may be suitable for the purposes for which they were designed, they would not be as suitable for the purposes of the present invention, as hereinafter described.

U.S. Pat. No. 5,640,147

Inventor: Lawrence Check

Issued: Jun. 17, 1997

A method for remotely monitoring the activities of a minor or dependent child or adult, on command from a parent unit. The child unit contains a sensitive audio-microphone to provide the holder of the parent unit the capability to periodically listen to activity in close proximity of the child unit, thereby offering the holder of the parent unit a measure of confidence in the state of well being of the holder of the child unit. The preferred embodiment provides a means to transmit an alert signal from the child unit to the parent unit in the event of an emergency. The transmission media used to interconnect both units is wireless, and may comprise radio frequency or infrared optical means, or any combination thereof.

U.S. Pat. No. 5,557,259

Inventor: John S. Musa

Issued: Sep., 17, 1996

A proximity alert and direction indicator is provided that allows an observer to monitor the proximity of a subject under surveillance, particularly a child. The subject wears a transmitter removably attached to the shoe. The observer wears a receiver-containing bracelet. The receiver contains a proximity detector with threshold set that emits an audible sound when the distance between the subject and the observer exceeds some preset distance. The receiver also contains a direction finder with graphic display that shows the observer the direction to the subject.

U.S. Pat. No. 5,646,593

Inventor: Michael Hughes et al.

Issued: Jul. 8, 1997

A child proximity detection unit includes two transceivers which communicate messages with one another. Only a properly authorized parent can attend a message to the child unit. However, a properly authorized parent can authorize another parent to adopt a child unit.

U.S. Pat. No. 5,689,240

Inventor: Norbert B. Traxler

Issued: Nov. 18, 1997

A system that transmits and receives signals comprising a master unit and a remote unit, wherein a separation distance between the master unit and a remote unit is continuously monitored and an alarm is activated on the master unit when no signal is received from the remote unit for at least a time longer than a preset interval. If the separation distance between the master and remote unit is exceeded for a time longer than a preset time interval, the remote unit activates an alarm attached to the remote unit. The master unit may also be used to activate manually the remote unit's alarm. A pin or key arrangement is provided that ensures that the remote unit is not deactivated without interfering with the master unit.

SUMMARY OF THE PRESENT INVENTION

The present invention relates generally to locator/proximity devices and, more specifically, to a device able to alert a person located at a central station when a remote device moves within a predetermined distance from the central station, the remote device being secured to a person or object being monitored.

A primary object of the present invention is to provide a locator system that will overcome the shortcomings of prior art devices.

Another object of the present invention is to provide a locator system able to alert a person located at a central base unit when a remote unit enters an area being monitored by the central base unit.

A further object of the present invention is to provide a locator system including a remote unit which is attached to a person or object to be monitored, the remote unit being able to communicate with the central base unit causing the central base unit to generate an alarm signal when the remote unit moves to within a predetermined distance from the central base unit.

Yet another object of the present invention is to provide a locator system wherein the central base unit transmits signals to and receives signals from the remote unit at a predetermined frequency, the remote unit receiving the signal transmitted by the central base unit and transmitting a response signal at the same frequency.

Still yet another object of the present invention is to provide a locator system wherein the central base unit will respond to the signal transmitted by the remote unit when the remote unit is within the predetermined distance from the central base unit by generating an alarm signal.

A yet further object of the present invention is to provide a locator system wherein the strength of the signal transmitted by the central base unit is adjustable to thereby adjust the predetermined distance.

An even further object of the present invention is to provide a locator system wherein the central base unit includes at least one of an audible and visual alarm when the remote unit moves to within a predetermined distance from the central monitoring unit.

Another object of the present invention is to provide a locator system wherein the remote unit may be secured to a book bag of a child thereby activating the central base unit to generate an alarm signal when the child is approaching the residence containing the central base unit.

Another object of the present invention is to provide a locator system wherein the activation of the alarm in the central base unit alerts the guardian of the child that a school bus in which the child is riding is approaching and thus the guardian should go to the bus stop.

Another object of the present invention is to provide a locator system that is simple and easy to use.

A still further object of the present invention is to provide a locator system that is economical in cost to manufacture.

Additional objects of the present invention will appear as the description proceeds.

A locator system for determining when an object has entered a predetermined monitoring area is disclosed by the present invention. The locator system includes a central base unit and at least one remote unit. The central base unit includes a transmitter for transmitting a monitoring signal within the predetermined area, an alarm signal generator and a receiver. Each of the at least one remote units includes a receiver for receiving the monitoring signal when positioned within the monitoring area and a device for generating and transmitting a response signal for receipt by the receiver in the central base unit. The central base unit is caused to generate an alarm signal upon receipt of the response signal thereby alerting a person monitoring the central base unit that the at least one remote unit has entered the monitoring area. The central base unit may include a device for adjusting a strength of the monitoring signal and thereby adjust the size of the monitoring area. Alternatively, the remote unit may include a device for adjusting a strength of the response signal and thereby adjust the size of the monitoring area. When more than one remote unit is being monitored by the central base unit each of the remote units is identified by a respective identification code, the identification codes being stored within a processor of the central base unit, the identification code being transmitted by respective remote units with the response signal.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

In order that the invention may be more fully understood, it will now be described, by way of example, with reference to the accompanying drawing in which:

FIG. 1 is a perspective view of the locator system of the present invention illustrating a central base unit transmitting a locator signal to a remote unit secured to a book bag of a child, the remote unit transmitting a response signal to the central unit thereby activating an alarm of the central base unit;

FIG. 1A an enlarged view of the central base unit of the locator system of the present invention taken from within the circle labeled 1A of FIG. 1;

DESCRIPTION OF THE REFERENCED NUMERALS

Figure 1:
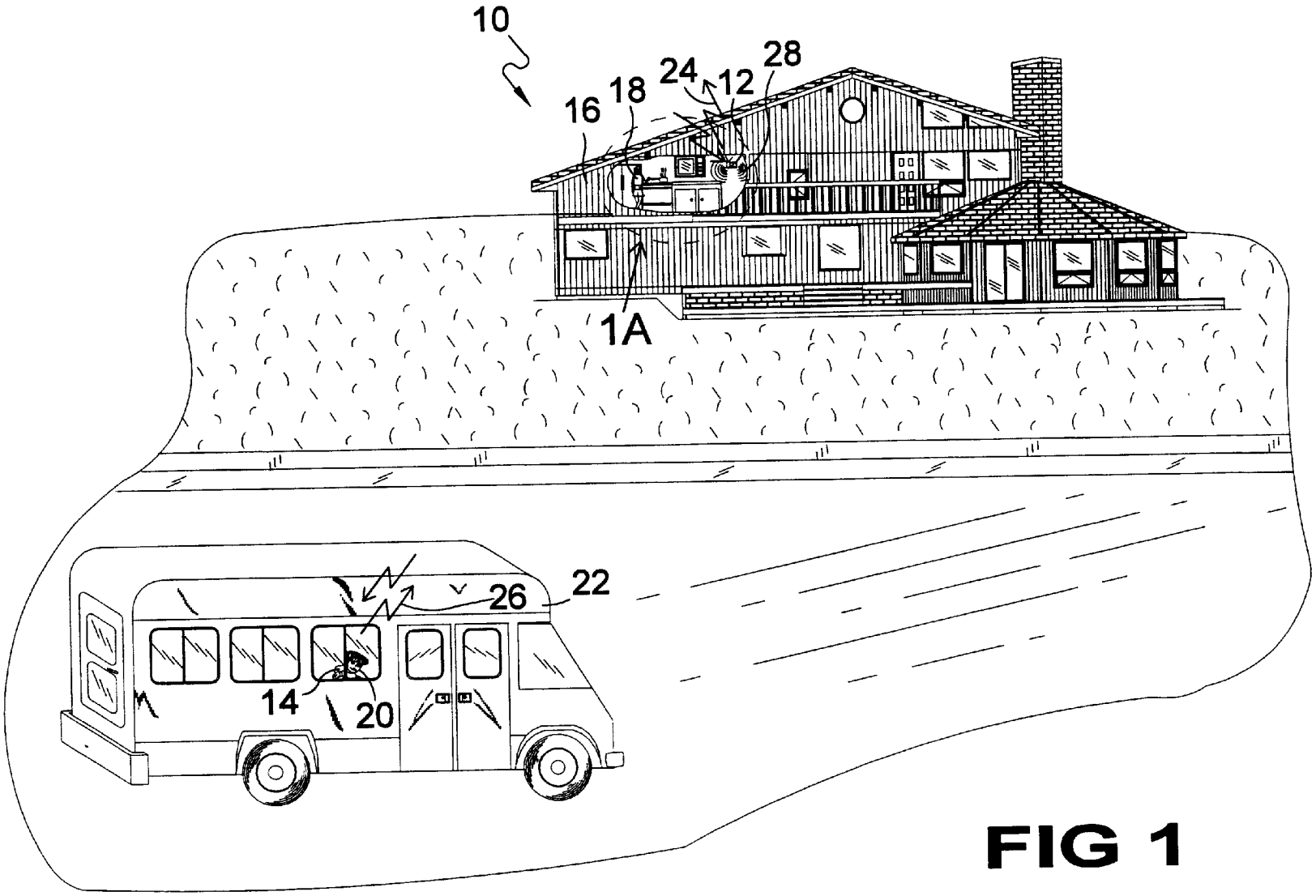

Turning now descriptively to the drawings, in which similar reference characters denote similar elements throughout the several views, the Figures illustrate the locator system of the present invention. With regard to the reference numerals used, the following numbering is used throughout the various drawing figures.

10 locator system of the present invention
12 central base unit
14 remote unit
16 structure in which central base unit is located
18 guardian in structure
20 child carrying remote unit
22 bus in which child is riding
24 arrow indicating location signal transmitted by central base unit
26 arrow indicating response signal transmitted by remote unit in response to receipt of location signal
28 lines indicating alarm signal generated by central base unit
30 antenna of central base unit
32 speaker of central base unit
34 visual alarm of central base unit
35 lines indicating visual alarm signal
36 switch for adjusting signal strength of location signal
37 electrical outlet
38 power switch for central unit
39 power cord
40 antenna of remote unit
42 power switch of remote unit
44 visual operating indicator of remote unit
46 visual alarm indicator of remote unit
48 device for securing remote unit to article carried by person being monitored
50 microprocessor of central base unit
52 power source of central base unit
54 transmitter of central base unit
56 receiver of central base unit
58 microprocessor of remote unit
60 power source of remote unit
62 receiver of remote unit
64 transmitter of remote unit

DETAILED DESCRIPTION OF THE PREFERRED EMBODIMENT

Turning now descriptively to the drawings, in which similar reference characters denote similar elements throughout the several views, FIGS. 1 through 5 illustrate the locator system of the present invention indicated generally by the numeral 10.

The locator system 10 is illustrated in FIG. 1 as including a central base unit 12 and a remote unit 14. The central base unit 12 is strategically positioned in a central location whereby a person 18 may easily monitor the central base unit 12. In this figure, the central base unit 12 is positioned in a room, e.g. the kitchen, of a dwelling 16. The remote unit 14 is secured to a person or object 20 to be monitored. In the present example, the remote unit is secured to a child 20 riding to school in a school bus 22. The locator system 10 is used in this example to alert a parent 18 as to the eminent arrival of a child 20 from school. Thus, the parent 18 is provided a warning signal prior to the arrival of the school bus 22 and is provided ample opportunity to travel to the bus stop and meet the child 20 upon exiting the school bus 22.

The central base unit 12 continually transmits a signal indicated by the arrow labeled with the numeral 24. The transmitted monitoring signals 24 is of a predetermined strength and at a predetermined frequency. The strength of the signal determines the size of the monitoring area of the locator system 10 which may be adjusted to change the size of the monitoring area. The size of the monitoring area determines the amount of time before arrival of the remote unit 14 that the person 18 monitoring the base unit 12 will be alerted. A stronger monitoring signals 24 will increase the size of the monitoring area and thereby increase the amount of time between being alerted and the arrival of the object or person 20 to which the remote unit 14 is secured. A weaker signal will decrease the size of the monitoring area and thereby decrease the amount of time between being alerted and the arrival of the object or person 20 to which the remote unit 14 is secured.

When the remote unit 14 travels into the monitoring area it will be able to receive the monitoring signals 24 transmitted by the central base unit 12. Upon receipt of the monitoring signals 24, the remote unit 14 will generate a response signal indicated by the arrow labeled with the numeral 26. The response signal 26 is transmitted to the central base unit 12 whereby upon receipt thereof an alarm signal indicated by the lines labeled with the numeral 28 is generated at the central base unit 12. The alarm signal 28 may be an audible signal, a visual signal or both for alerting the person monitoring the central base unit 12 as to the entry of the remote unit 14 into the monitoring area.

Figure 1A:
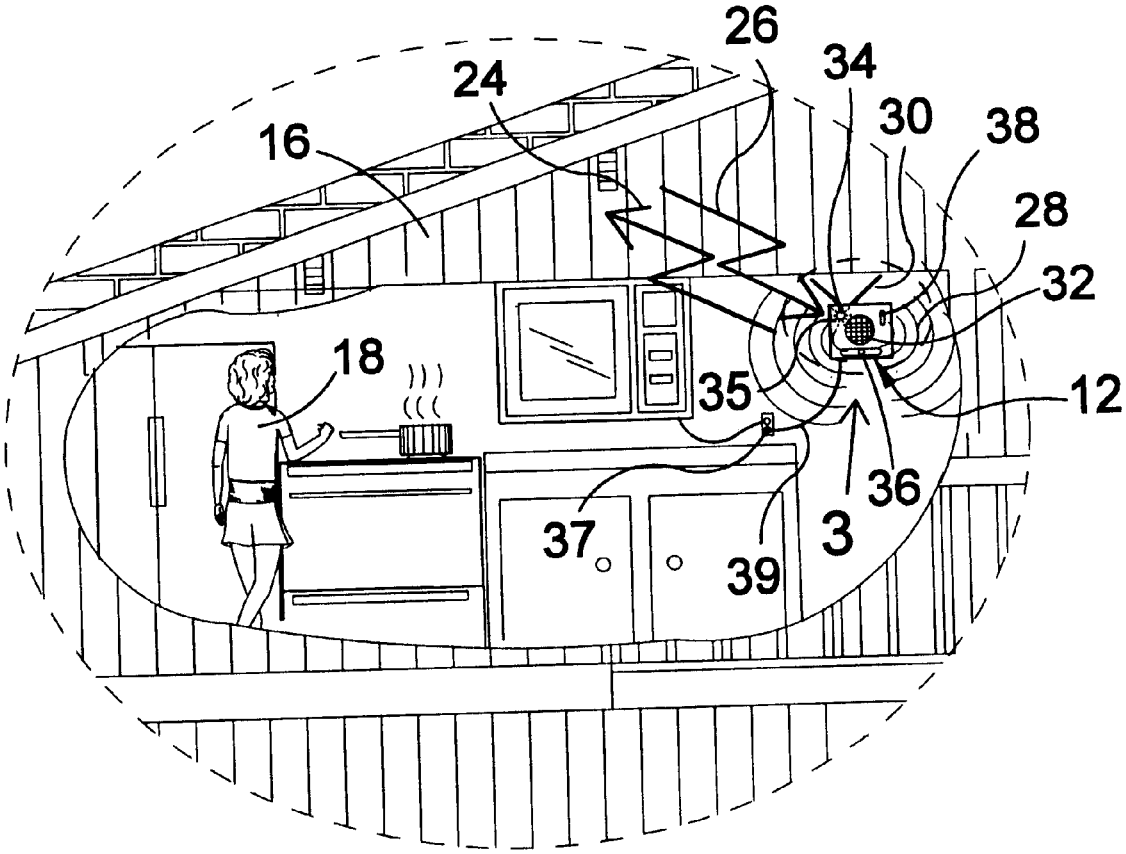

An enlarged view of the central base unit 12 taken from within the circle labeled 1A of FIG. 1 is illustrated in FIG. 1A. From this figure the central base unit 12 is shown secured to a wall of a kitchen within a dwelling 16. The monitoring signals 24 is shown being transmitted by the central base unit 12 and the response signal 26 is shown being received from the remote unit 14. The monitoring signals 24 is continually transmitted by the central base unit 12 when turned on and the response signal 26 is only received from the remote unit 14 when the remote unit is within the monitoring area. Upon receipt of the response signal 26, the alarm signal 28 is generated by the central base unit 12 to alert the person 18 as to the movement of the remote unit 14 into the monitoring area.

The central base unit 12 includes an antenna 30 for transmitting the monitoring signals 24 and receiving the response signal 26. An audible alarm signal generator 32, e.g. a speaker unit, is provided for generation of the audible alarm signal 28. A visual alarm generator 34 is provided on the central base unit 12 for generation of a visual alarm indicated by the lines labeled with the numeral 35. An adjustment device 36 is provided for adjusting the signal strength of the transmitted monitoring signals 24 and thereby adjust the size of the monitoring area. A power switch 38 is further provided for turning the central base unit 12 on and off, thereby controlling when the monitoring signals 24 is generated for transmission. The central base unit 12 may be connected to receive power from an electrical outlet 37 via a power cord 39. Alternatively, the central base unit 12 may include an internal power source for providing the needed operating power.

Figure 2:
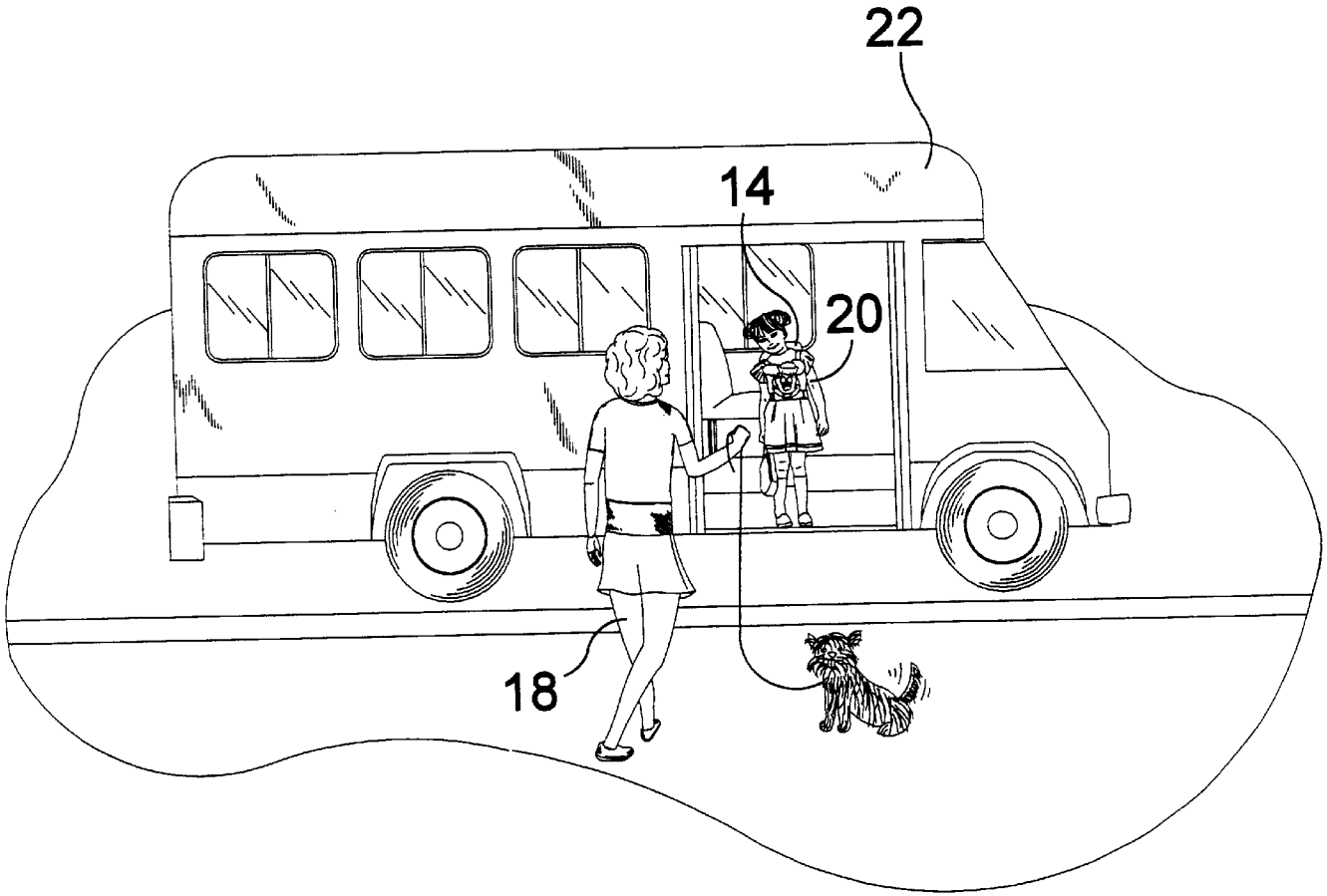
FIG. 2 is a front perspective view of a guardian meeting a child carrying the remote unit of the locator system of the present invention after being alerted to the approaching bus by the central base unit.

FIG. 2 illustrates an enlarged view of a person 18 monitoring the central base unit 12 meeting a child 20 carrying the remote unit 14. The central base unit 12 generates the alarm signal upon receipt of the response signal 26 from the remote unit 14 to thereby alert the person 18 as to the entry of the remote unit 14 into the monitoring area. The person 18 monitoring the central base unit 12 is then provided an opportunity to greet the person 20 to which the remote unit 14 is attached at a desired location, in this instance a school bus stop. A parent is thus able to meet their child at the bus stop and bring the child home safely.

Figure 3:
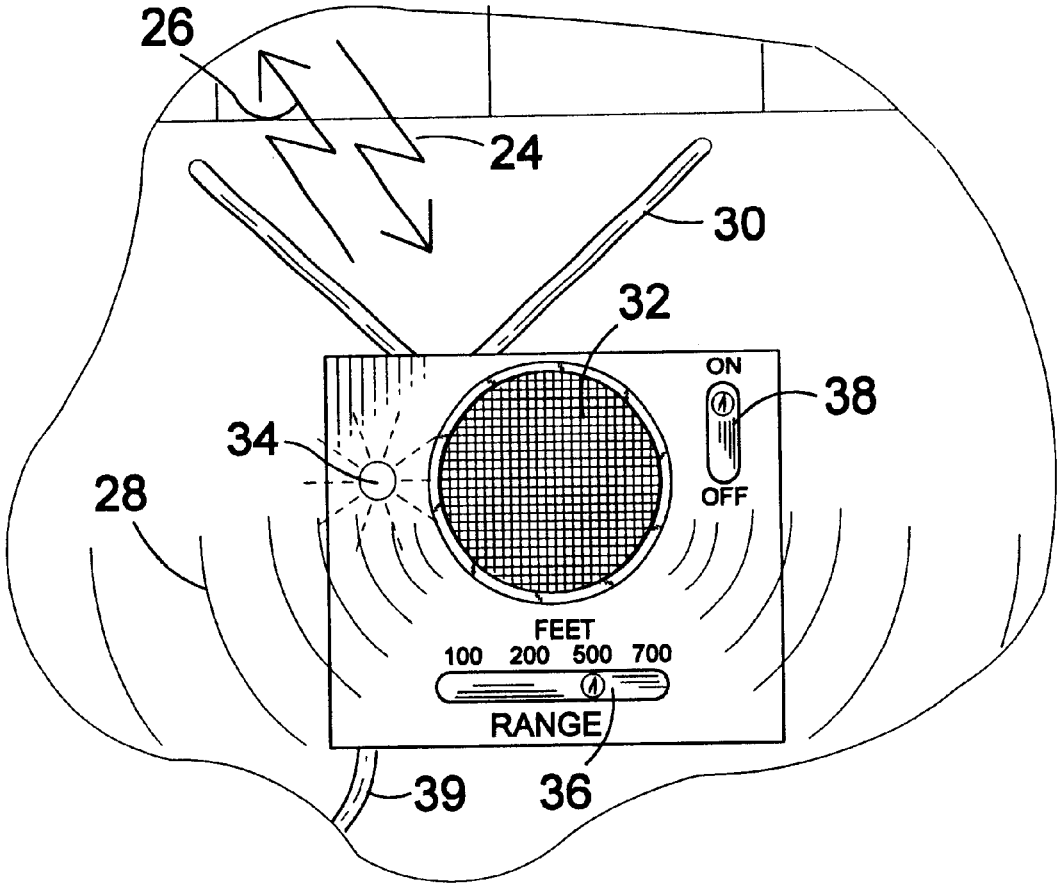
FIG. 3 is an enlarged view of the central base unit of the locator system of the present invention.

A front view of the central base unit 12 is illustrated in FIG. 3. From this figure it is seen that the central base unit 12 includes an antenna 30 for use in transmitting monitoring signals 24 to the remote unit 14 and receiving response signals 26 from the remote unit 14. On a face side of the central base unit 12 is an audible alarm generator 32 such as a speaker unit. The audible alarm generator 32 generates the audible alarm indicated by the numeral 28 for alerting the person 18 monitoring the central base unit 12. The person 18 is alerted that a response signal 26 has been received from the remote unit 14 and thus, the remote unit 14 is within the monitoring area. A visual alarm signal generator 34 is also provided on the face side of the central base unit 12 to provide a visual indication that a response signal 26 has been received from the remote unit 14 and thus, the remote unit 14 is within the monitoring area. The visual alarm generator may be an LED or any other device suitable for visually alerting the person 18 as to the receipt of a response signal 26 from the remote unit 14. A switch 36 for adjusting the signal strength of the transmitted monitoring signals 24 is provided on the face side of the central base unit 12. The switch 36 includes indicia indicated by the numeral 37 for aiding the user in selecting the radius of the monitoring area as measured from the central base unit 12. A power switch 38 is provided for connecting the central base unit 12 to a source of power and thus begin generation and transmission of monitoring signals 24. The power cord 39 may be provided to connect the central base unit 12 to an external source of power.

Figure 4:
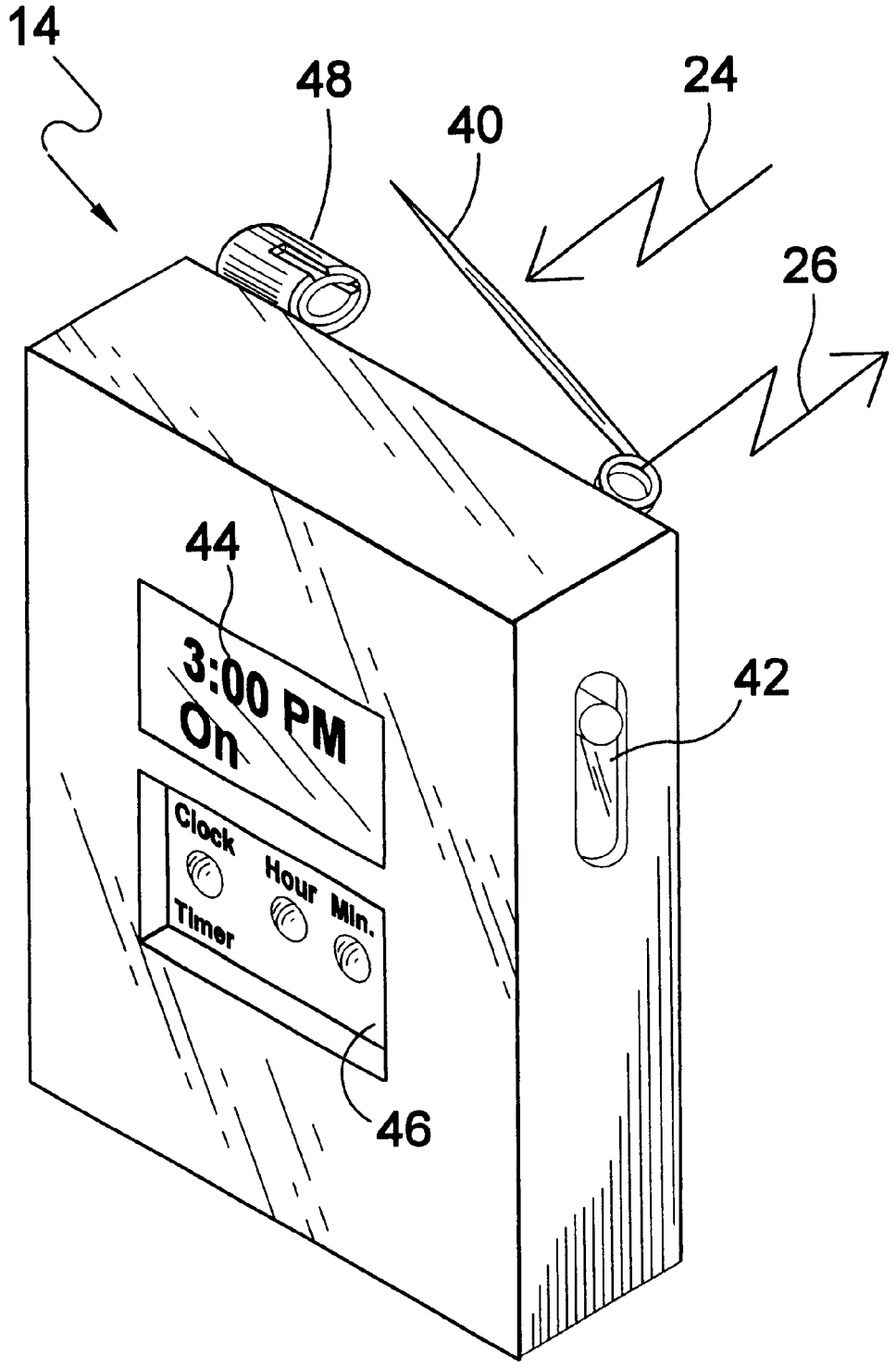
FIG. 4 is an enlarged top perspective view of the remote unit of the present invention.

A perspective view of the remote unit 14 is illustrated in FIG. 4. From this figure it is seen that the remote unit 14 includes an antenna 40 for receiving the monitoring signals 24 from the central unit 12 and transmitting the response signals 26 to the central base unit 12. The remote unit 14 is able to receive the monitoring signals 24 only when present within the monitoring area as the monitoring signals 24 are not strong enough to travel beyond the monitoring area. Upon receipt of the monitoring signals 24, the remote unit 14 will automatically generate the response signal 26 indicating the monitoring signal has been received. Provided on a face side of the remote unit 14 is a display 44 for displaying the time of day and a switch box for setting the correct time of day to be displayed on the display 44. A clip 48 is provided on the remote unit 14 for releasably securing the remote unit to an object or piece of clothing of a person to be monitored.

Figure 5:
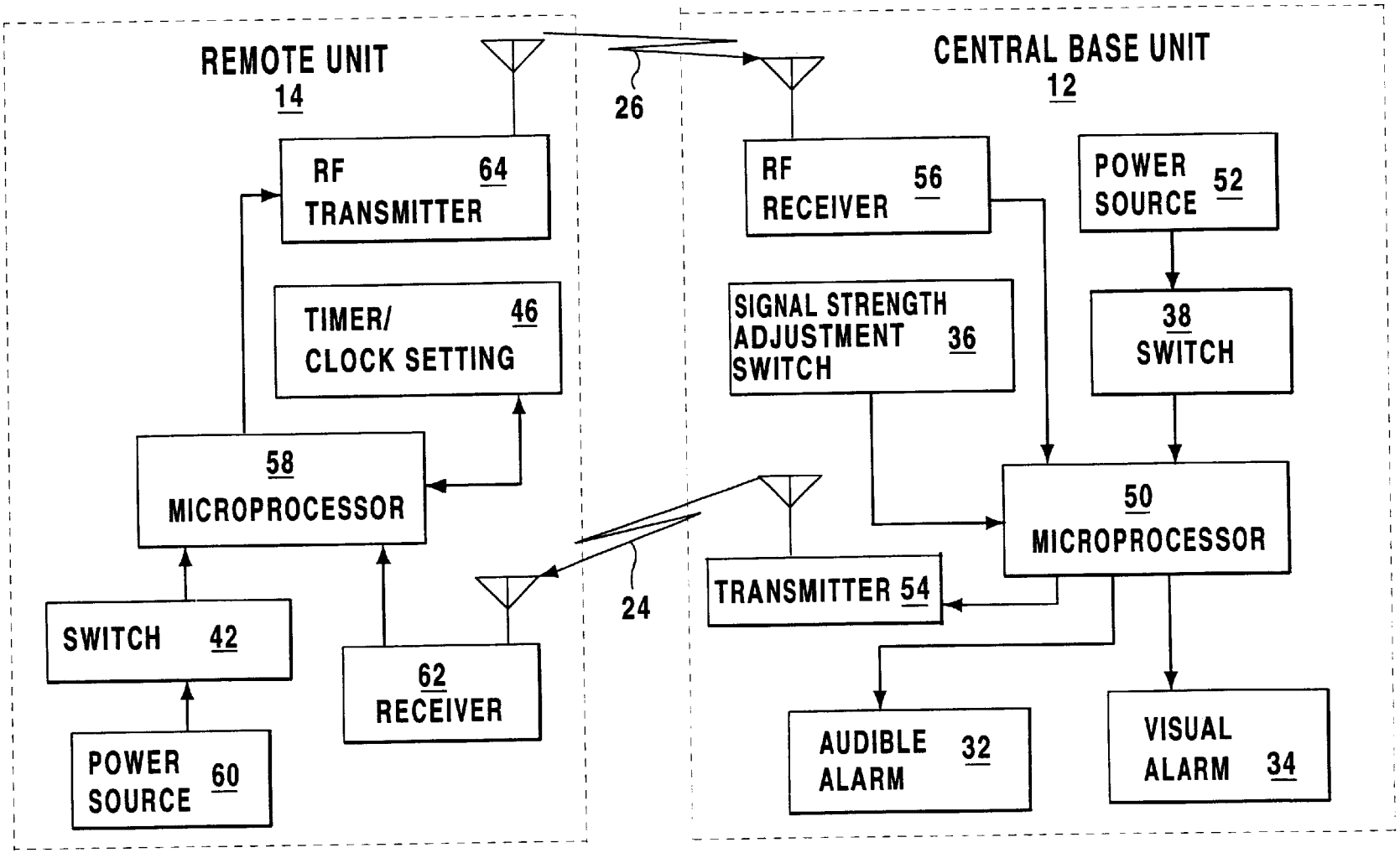
FIG. 5 is a diagrammatic view of both the central base unit and remote unit of the present invention.

A block diagram illustrating the internal components of both the central base unit 12 and the remote unit 14 is shown in FIG. 5. As can be seen from this figure, the central base unit includes a microprocessor 50. The microprocessor receives power from a power source 52 via the power switch 38. Power is distributed throughout the central base unit 12 via the microprocessor 50. A transmitter 54 is connected to and controlled by the microprocessor 50 for transmitting the monitoring signals 24 to the remote unit 14. The signal strength adjustment switch 36 is provided connected to the microprocessor 50 for adjusting the strength at which the monitoring signal is transmitted by the transmitter 54 and thus setting the size of the monitoring area. When the remote unit 14 is within the monitoring area and receives the monitoring signal, a response signal is generated and transmitted back to the central base unit 12. A receiver 56 is provided within the central base unit 12 for receiving the response signal 26 and relaying the response signal to the microprocessor 50 for processing. Upon receipt of the response signal 26, the microprocessor 50 will trigger the audible alarm 32 to generate an audible alarm signal and the visual alarm 34 to generate a visual alarm thereby alerting the person 18 monitoring the central base unit 12 that a response signal 26 has been received from the remote unit 14 and thus, the remote unit 14 is within the monitoring area.

The remote unit 14 also includes a microprocessor 58 which is also connected to an internal power source 60 via the power switch 42. A receiver 62 is provided within the remote unit 14 for receiving the monitoring signal when the remote unit 14 enters the monitoring area. The receiver is connected to the microprocessor 58 and provides the received monitoring signals to the microprocessor 58 for analysis. The timer/clock 46 is connected to the microprocessor 58 and may be manually set using the timer setting buttons illustrated in FIG. 4. A transmitter 64 also connected to the microprocessor 58 and upon receipt of a signal from the microprocessor 58, the transmitter 64 will generate and transmit the response signal 26 to the central base unit 12. The response signal 26 may include data indicating the time set on the timer/clock 46 therewith to alert the person monitoring the central base unit 12 as to the time the remote unit 14 entered the monitoring area.

Figure 6:
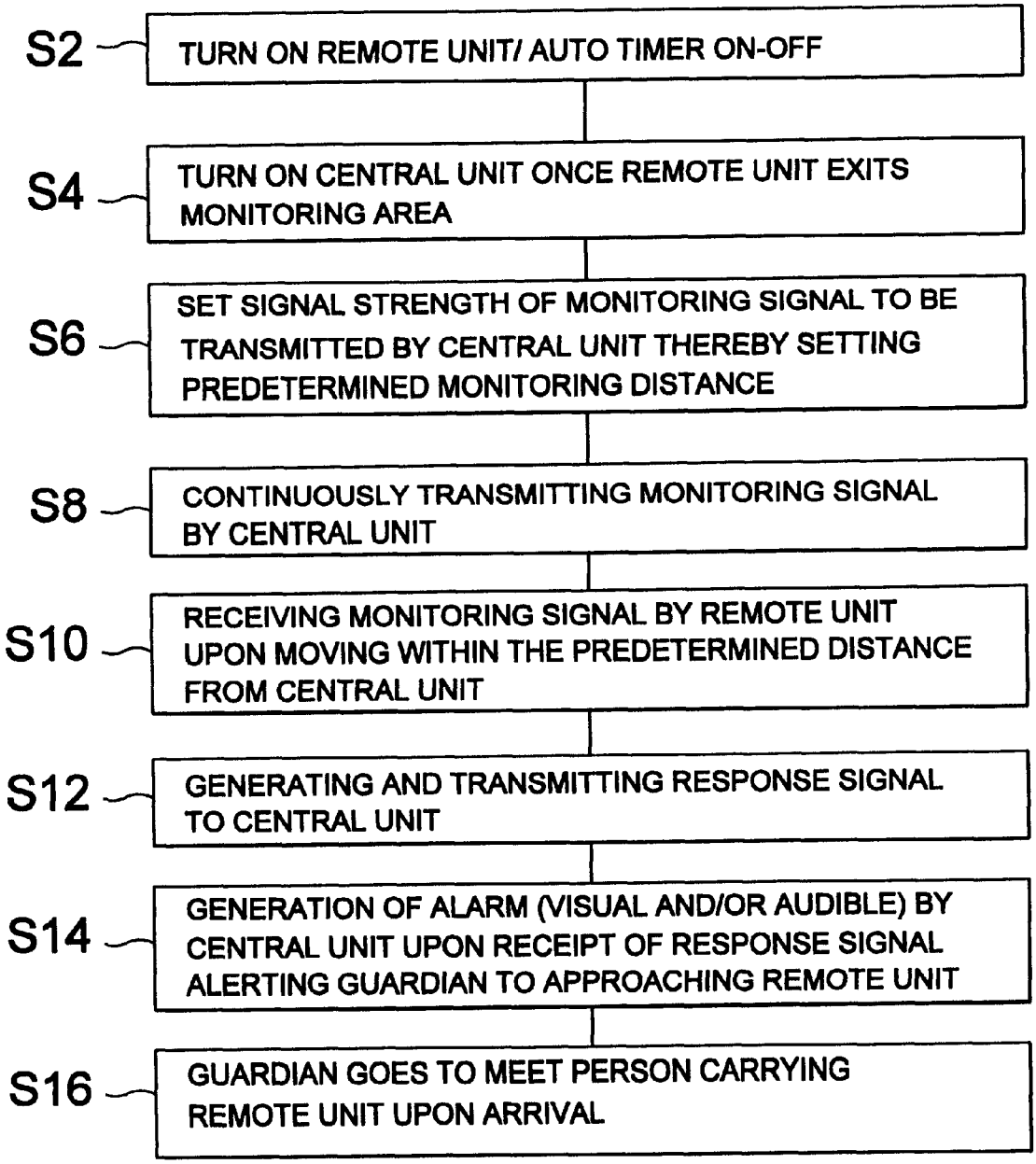
FIG. 6 is a flow diagram illustrating the method of operation of the locator system of the present invention.

The operation of the locator system 10 will now be described with reference to the figures and specifically FIG. 6. In operation, the locator system 10 is adapted for use by securing the remote unit to an object or person to be monitored and turning on the power switch 42 thereby activating the remote unit 14 as described in step S2. Then once the remote unit 14 is outside the monitoring area, the power switch 38 on the central base unit 12 is turned to the on position as stated in step S4. The signal strength of the monitoring signal to be transmitted by the central base unit 12 and thus the size of the monitoring area is then set by adjusting the switch 36 as disclosed in step S6. Alternatively, the central base unit 12 may be set to transmit signals at a predetermined signal strength while the strength of the response signal 26 transmitted by the remote unit 14 may be adjusted. In this embodiment, the strength of the response signal transmitted by the remote unit 14 will determine the size of the monitoring area.

The central base unit will continuously generate and transmit the monitoring signal 24 for as long as it is turned on and thereby receiving power from the power source as described in step S8. When the remote unit 14 enters the monitoring area, it will receive the monitoring signal, thereby indicating the remote unit is within a predetermined distance from the central base unit as stated in step S10. If the signal strength of the response signal 26 determines the size of the monitoring area, the remote unit 14 will be able to receive the monitoring signals 24 beyond the distance defining the monitoring area. However, due to the signal strength of the response signal any signal generated and transmitted by the remote unit 14 will not be strong enough to be received by the central base unit 12 until the remote unit 14 enters the monitoring area.

Upon receipt of the monitoring signal 24, the remote unit will provide the received monitoring signal to the processor for analysis. The processor will then cause the transmitter 64 in the remote unit to generate and transmit the response signal 26 to the central base unit 12 as disclosed in step S12. When the response signal 26 is received by the central base unit 12, at least one of the audible and visual alarm signal generators will be activated to generate an alarm signal as described in step S14. The alarm signals alert the person monitoring the central base unit 12 that the remote unit 14 has entered the monitoring area. At this point, the person 18 monitoring the central base unit 12 will go to meet the person or object being monitored at a predetermined location.

It is to be realized that a plurality of remote units 14 may be simultaneously monitored by the central base unit 12. In this instance, each remote unit 14 would be adapted to receive the monitoring signal 24 from the central base unit 12 when positioned within the monitoring area. Each remote unit 14 would be identified by a respective code number, the code numbers identifying each remote unit 14 being stored within the processor 50 of the central base unit 12. When each remote unit 14 receives the monitoring signal 24, they will generate a response signal 26 including an identification code recognizable by the central base unit 12. Thus, the central base unit 12 will be able to identify which of the remote units are present within the monitoring area and alert the person monitoring the central base unit 12 as to such.

From the above description it can be seen that the locator system of the present invention is able to overcome the shortcomings of prior art devices by providing a locator system which is able to alert a person located at a central base unit when a remote unit enters an area being monitored by the central base unit. The locator system includes a remote unit which is attached to a person or object to be monitored, the remote unit being able to communicate with a central base unit causing the central base unit to generate an alarm signal when the remote unit moves to within a predetermined distance from the central base unit. The central base unit transmits signals to and receives signals from the remote unit at a predetermined frequency, the remote unit receiving the signal transmitted by the central base unit and transmitting a response signal at the same frequency whereby the central base unit will respond to the signal transmitted by the remote unit when the remote unit is within the predetermined distance from the central base unit by generating an alarm signal. The locator system is able to adjust the size of the area monitored thereby by changing the strength of the signal transmitted by the central base unit. Furthermore, the locator system of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. The method of alerting a parent or guardian to the imminent return of a child allowing said parent or guardian to greet said child at a predetermined location away from the home comprising the steps of:

a) transmitting from a central base unit in the home a monitoring signal at a predetermined frequency and adjusting the strength of said signal to establish a predetermined monitoring area covering said predetermined location;

b) securing a remote unit to a book bag accompanying said child, said remote unit having means for receiving said monitoring signal when said remote unit enters said monitoring area and transmitting a response signal at said predetermined frequency for receipt by said central base unit;

c) said central base unit generating an alarm signal upon receipt of said response signal alerting said parent or guardian that said child is about to reach said predetermined location; and d) said parent or guardian proceeding to said predetermined location to meet said child.

* * * * *